United States Patent [19]

Hotten

[11] 4,049,562

[45] Sept. 20, 1977

[54] EXTREME PRESSURE LUBRICANT COMPOSITIONS

[75] Inventor: Bruce W. Hotten, Orinda, Calif.

[73] Assignee: Chevron Research Company, San Francisco, Calif.

[21] Appl. No.: 677,331

[22] Filed: Apr. 15, 1976

[51] Int. Cl.[2] ..... C10M 1/26; C10M 1/38; C10M 1/46

[52] U.S. Cl. ..... 252/46.7; 252/48.4; 252/49.9; 252/56 R

[58] Field of Search ..... 252/56 R, 49.9, 48.4, 252/46.7

[56] References Cited

U.S. PATENT DOCUMENTS

| | | | |
|---|---|---|---|
| 2,216,752 | 10/1940 | Rosen | 252/47.5 |
| 2,691,000 | 10/1954 | Elliott | 252/48.4 |
| 3,074,886 | 1/1963 | Tierney et al. | 252/49.8 |
| 3,219,582 | 11/1965 | Gaertner | 252/56 R |
| 3,223,635 | 12/1965 | Dwyer et al. | 252/56 R |
| 3,720,615 | 3/1973 | Izumi et al. | 252/56 R |
| 3,813,339 | 5/1974 | Boehringer et al. | 252/56 S |
| 3,923,672 | 12/1975 | Durr et al. | 252/49.9 |

*Primary Examiner*—Arthur P. Demers
*Attorney, Agent, or Firm*—C. J. Tonkin; J. Tedd Brooks

[57] ABSTRACT

An extreme pressure lubricant is provided comprising a major portion of a lubricating oil or grease and a minor portion of an extreme pressure additive which is a partial ester of a di- or tricarboxylic acid of 21 to 80 carbon atoms alone or in combination with either or both of a hydrocarbylthio ether and a phosphate ester.

9 Claims, No Drawings

EXTREME PRESSURE LUBRICANT COMPOSITIONS

BACKGROUND OF THE INVENTION

1. Field of the Invention

The control of friction and wear under high load conditions requires boundary lubrication. Boundary lubrication appears to depend on the properties of the lubricant other than its viscosity. Boundary lubrication can be achieved by the formation of films on the metallic surface. While the formation of such film is thermodynamically favored, the thickness of the surface film ranges from a few-hundredths of a microinch for single molecule layers of adsorbed gases to several dozen microinches for thick films from oils with extreme pressure (EP) additives. A problem in the lubrication art is to provide a boundary film with the proper chemical and physical characteristics to control friction and/or wear under high load conditions, and the correct chemical properties to avoid detrimental damage to the surface and other disadvantageous effects such as toxicity, oxidation catalysis and sludge deposition.

It is important for many applications that the lubricating compositions give a minimum value of 60 pounds in the Timken Extreme Pressure Test (ASTM D2782-71). A 60-pound minimum requirement is ordinarily set by the U.S. steel industry and by other industrial users of extreme pressure gear oils. The novel combination additives of the present invention provide lubricants which easily exceed this requirement, and, in fact, the preferred ternary combinations provide EP values in the Timken test as high as any EP additives known. They also produce compositions of excellent stability, and low wear.

DESCRIPTION OF THE PRIOR ART

U.S. Pat. No. 2,830,021 discloses lubricant compositions containing as corrosion inhibitors aliphatic amine salts of monoalkylesters of dimeric acids. No EP properties are claimed for the materials, and, in fact, tests show that these salts negate the EP effect of the other additives.

SUMMARY OF THE INVENTION

Lubricating compositions possessing outstanding extreme, antifriction and antiwear properties are provided. The compositions contain in a lubricating oil or grease base, an additive which comprises a single type of compound or a combination of that type of compound with one or two additional types of compounds. The first and necessary component is a partial ester of an aliphatic or alicyclic dicarboxylic or tricarboxylic acid. The second component is a thioether (including mono and dithioethers). The third component is a phosphate ester. Thus, while the use of the partial ester alone will produce substantial improvement in extreme pressure performance, the use of a combination of the ester with either the thioether or the phosphate, and preferably with both, imparts outstanding extreme pressure properties to the lubricating compositions in which they are employed.

The lubricating compositions thus comprise a major portion of a lubricating oil or grease base and a minor portion, from about 0.2 to 10 weight percent of the EP additive, the additive comprising one part of a partial ester of a di- or tricarboxylic acid of from about 21 to 80 carbon atoms.

The second component is a polydithioether or thioether having a molecular weight of from about 50 to 10,000 and a sulfur content of at least 5% by weight. This component is generally employed in amounts of 0 to 10 parts relative to the partial ester.

The third component is an alkyl or aryl or mixed alkyl aryl phosphate ester employed in amounts of 0 to 10 parts relative to the partial esters.

The composition will thus comprise the lubricating oil (or grease) base and the minor portion, usually not more than 10% by weight of the additive (or additive combination).

DESCRIPTION OF THE INVENTION

The Partial Esters

The esters employed as the extreme pressure agent (or as part of the combination agent) are as indicated derived from di- or tricarboxylic acids. The acids may be saturated or unsaturated, aromatic, aliphatic or alicyclic. They will contain from about 18 to 80, preferably from about 21 to 57 carbon atoms.

Representative of the acids are the so-called dimer and trimer acids. These materials are usually produced by polymerizing unsaturated $C_{18}$ fatty acids to produce $C_{36}$ or $C_{54}$ di- or tricarboxylic acids. The acids used are usually linoleic and oleic acids. The unsaturated dimer acids may be hydrogenated before or after esterification.

Representative acids which may be polymerized include dimers of dienoic acids including sorbic, linoleic, humoceric, eicosenic acid as well as trienoic acids such as linolenic and cleostearic. Mixtures of the various dienoic and trienoic acids may also be employed.

Examples of the acids include the dimer and trimer acids marketed by Emery industries as Empol Dimer and Trimer Acids. These materials are described in U.S. Pat. No. 3,000,916. These acids are illustrated by Empol 1022 having a molecular weight of about 510.

Another class of acids which may be employed is represented by those acids which are produced by the reaction of acrylic acid with a conjugated unsaturated acid such as linoleic acid. An acid of this type is described in an article entitled "Industrial Utilization of $C_{21}$ Dicarboxylic Acid" Ward, Force, and Bills, *J. Am. Oil Chemists Soc.*, July, 1975, indicating the commercial availability of the acid 5(6)-carboxy-4-hexyl-2-cyclohexene-1-octanoic acid.

The esters employed in the compositions of this invention are produced by conventional means, e.g. acid catalysis, etc. However, care must be taken (by use of the proper reactant ratios) to ensure that free acidic hydroxyl groups remain in the acid. Thus, when diacids or triacids are employed, the active materials will contain at least one free hydroxyl group on the acid. Of course, since the products will generally comprise mixtures, the presence of quantities of unesterified (free acid) or completely esterified molecules will not detract from performance as long as the requisite quantity of the active partial esters are present.

Thus, the active component will comprise the monoester in the case of the diacids and a mono- or diester of the triacids.

Since the mixtures will not usually be separated, the ester component will usually comprise a mixture of dicarboxylic or tricarboxylic acids which are esterified from about 40% to 80%, preferably from about 30% to 70%.

The alcohol moiety of the molecule will contain from 1 to about 10 carbon atoms, and may be cyclic or acyclic, saturated or unsaturated. Examples of suitable alcohols include methyl, ethyl, propyl, amyl, hexyl, heptyl, octyl, etc., benzyl, etc. Preferred materials will have from 3 to 8 carbon atoms. Also preferred are aliphatic alcohols and particularly preferred is the ester derived from isopropyl alcohol.

The ester will be present in amounts of from about 0.2 to 10% relative to weight of lubricating oil or grease base in which the materials are employed.

The Phosphate Esters

The phosphate ester component of the invention are hydrocarbyl phosphates including alkyl, or aryl or mixed alkyl aryl phosphates. The compounds will usually have a molecular weight in the range of 100 to 10,000, preferably in the range of 100 to 1000. Examples of the phosphates are trialkyl phosphates such as tripropyl phosphate, ethyldipropyl phosphate, tributyl phosphate, triaryl phosphate, trihexyl phosphate, etc.

Suitable mixed alkyl aryl phosphates include dibutyl phenyl phosphate, diamyl cresyl phosphate, etc.

Examples of the suitable aryl phosphate include triphenyl phosphate, tricresyl phosphate, diphenyl cresyl phosphate, etc.

The preferred phosphate is tricresyl phosphate.

The Thioether

The thioethers which comprise the third optional component of the EP additive, as mentioned include compounds having molecular weights from about 100 to 10,000, preferably from about 100 to 1000. The thioethers will have a minimum sulfur content of about 5% by weight. One type of the thioethers can be represented, in general, by the formula H(R—S—S—)—xH wherein R is a hydrocarbylene radical (a divalent hydrocarbon radical) of from 2 to about 30 carbon atoms and $x$ is an integer 2 to 100.

An example of a material of this type is poly(butenedisulfide) having a molecular weight of about 200–1000.

Another class of thioethers which may be suitably employed comprises sulfurized cracked wax olefins. These compounds are produced by reacting sulfur with olefins at a temperature (140°–180° C) produced by the cracking of petroleum wax fractions. The sulfurized cracked waxes have molecular weights in the range of 100 to 500.

A third type of thioether which may be suitably employed are the sulfurized esters and sulfochlorinated esters of olefinic mono- or dicarboxylic acids which do not contain allylic hydrogen atoms as disclosed in U.S. patent application Ser. No. 592,934, the teachings of which are incorporated by reference.

These materials are illustrated by the following reaction formulas using acrylate esters as examples:

(1) Sulfurized ester

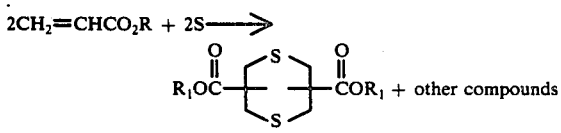

(2) Sulfochlorinated ester

-continued

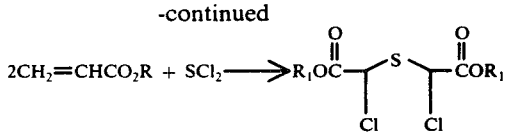

$R_1$ is usually a aliphatic and may contain olefinic unsaturation.

The EP Additive Combination

The EP additive is employed in weight concentrations of up to about 10% in the lubricant (oil or grease). As previously mentioned, the partial ester is essential but may be combined for superior performance with the thioether or with the phosphate and preferably with both.

The additive will thus comprise one part by weight of the partial ester (A), 0 to 20 parts each of the thioether (B) and the phosphate ester (C). Preferably, from 0.5 to 2 parts of B and C will be employed. A particularly preferred composition will comprise about equal quantities of A, B and C.

The Lubricant Base

The EP additive may be used in an oil of lubricating viscosity. The lubricating oil can be any relatively inert and stable fluid of lubricating viscosity. Such lubricating fluids generally have viscosities of 35–50,000 Saybolt Universal Seconds (SUS) at 100° F. The fluid medium or oil may be derived from either natural or synthetic sources. Included among the natural hydrocarbonaceous oils are paraffin-base, naphthenic base, or mixed base oils. Synthetic oils include polymers of various olefins, generally from 2 to 6 carbon atoms, alkylated aromatic hydrocarbons, etc. Non-hydrocarbon oils include polyalkylene oxides, aromatic ethers, silicones, etc. The preferred media are the hydrocarbonaceous media, both natural and synthetic. Preferred are those hydrocarbonaceous oils having viscosity of about 100–4000 SUS and particularly those having viscosity from 200 to 2000 SUS at 100° F. The compounds of this invention may also be used singly, or preferably in combinations of two or more in lubricating greases. Greases comprise oils thickened by gellants or thickeners which are lithium, sodium, and calcium soaps, synthetic soap-like salts, non-carboxylic salts, polymers, or various inorganic compounds; the oils include petroleum oils and polysiloxanes.

Lubricating oil or grease will be present at 75% or greater by weight of the final lubricant composition. In concentrates, however, the oil may be present as 10–75% by weight. These concentrates are diluted with additional oils prior to being placed in service to obtain the requisite concentration.

Other additives may also be present in the composition of this invention. Materials may be added to enhance the EF effect of the additive or provide some other desirable properties to the lubricating medium. These include such additives as rust and corrosion inhibitors, antioxidants, oiliness agents, detergents, foam inhibitors, anti-wear agents, viscosity index improvers, pour point depressants, etc. Usually these will be in the range of about 0–5% by weight, more generally in the range of from about 0–2% by weight of the total composition. Typical additional additives found in compositions of the present invention include phenolic and arylamine antioxidants, zinc dihydrocarbyldithiophosphates, rust inhibitors, such as the metal sulfonates and foam inhibitors such as the polyethyl siloxanes, etc.

EXAMPLE A

Preparation of partial ester of dimer acid 2328 g (4.6 mols) of Empol 1022, a dimer acid having a molecular weight of 510, 632 g of 2-propanol and 52 g of Amberlyst 15 (a sulfonated polystyrene resin esterification catalyst) were placed in a 4-liter resin flask equipped with a heater and a reflux condensor. The mixture was heated at reflux with periodic samples being extracted and the degree of esterification being determined by acid number titration with KOH. At the end of 12½ hours the acid was 42% esterified. Heating was stopped and the product was filtered through coarse sintered glass and stripped to 130° C under vacuum. The total product was 2418 g.

Lubricant Performance

The load-carrying capacity of the lubricating fluids and the base oil was tested by means of the Timken Extreme Pressure Test (ASTM D 2782-71) and the Four-Ball wear test (ASTM D2266-67). These tests are widely used for specification purposes and differentiate between lubricating fluids having low, medium, and high levels of extreme pressure properties. In the Timken test a steel cup is rotated against a steel block. The rotating speed is 800 r.p.m. and fluid samples are preheated to 38° C before starting the test. Two determinations are made: the minimum load value which will rupture the lubricant film being tested between the rotating cup and the stationary block and cause abrasion, and the maximum load at which the rotating cup will not rupture the lubricating film and cause abrasion between the rotating cup and the stationary block. Thus, the Timken test defines the load carrying capacity of a lubricant as the maximum load or pressure which can be sustained by the lubricant when used in a given system under specific conditions without failure of moving bearings or sliding contact surfaces as evidenced by seizure or welding. Seizure or welding is evidenced by streaks appearing on the surface of the test cup, an increase in friction and wear, or unusual noise and vibration.

In addition, the compositions are subjected in an "Oxidation Test", and an ASTM Copper Corrosion Test.

The Oxidation Test is used to determine antioxidant activity. To 25 g of the test oil is added 0.26 cc of a solution having 2268 ppm of copper, 6236 ppm of iron, 567 ppm of manganese, 4535 ppm of lead, and 4535 ppm of chromium, all as their naphthenates, providing a distribution of metals which would be expected to be found in a used crankcase oil from a General Motors D-71 diesel engine. The oil sample to be tested is maintained at 340° F with stirring in an oxygen atmosphere and the percent increase in viscosity at 100° F in ten hours determined.

The following examples illustrate the compositions of this invention. Blends of various esters, thioethers and phosphates in base oil were prepared and subjected to the previously described Timken EP Test, the Four-Ball Wear Test, and the ASTM D-130 Copper Corrosion Test (run at 250° F for 3 hours).

The materials blended were as follows.

Partial Esters $A_1$ Mono isopropyl ester of dimerized linoleic acids
$A_2$ Mono butyl ester of dimerized linoleic acid
$A_3$ Mono isopropyl ester of trimerized linoleic acid
$A_4$ Mono isopropyl sebacate
$A_5$ Mono isopropyl n-dodecenyl succinate
$A_6$ Mono isopropyl tetrapropenyl succinate
$A_7$ Dodecylamine salt of $A_1$

Phosphates $B_1$ Tricresyl phosphate
$B_2$ Dibutyl phenyl phosphate
$B_3$ Tributyl phosphate
$B_4$ Tri(p-isopropylphenyl)phosphate

Thioethers $C_1$ Poly(isobutenedithioether) (Anglamol 32)
$C_2$ Sulfidized isodecyl acrylate
$C_3$ Sulfidized $C_{15}$–$C_{18}$ cracked wax olefin (13% S)
$C_4$ Sulfidized $C_{10}$ cracked wax olefin (18% S)
$C_5$ Sulfidized $C_8$–$C_9$ cracked wax olefin (21% S)
$C_6$ Sulfidized paraffin containing 18% S and 2% Cl
$C_7$ Sulfidized $C_{15}$–$C_{18}$ cracked wax olefin (11% S)

The base oil employed in the tests was a 120 grade gear oil comprising 70% by weight of a bright stock having a viscosity of 150 SUS at 210° F. and 30% by weight of a neutral oil having a viscosity of 350 SUS at 100° F.

The data acquired from the tests on the compositions are set forth in Table I. The proportion of each additive is expressed in weight percent of the total composition.

TABLE I

Properties Of EP Agent Blends

| Ex. | Additive Type | Additive Conc. Wt. % | 4 Ball Wear Test 20 Kg, mm | Timken Load, lbs. | Copper Corrosion ASTM D-130 Rating | Oxidation Test, Hours |
|---|---|---|---|---|---|---|
| 1 | None (base oil alone) | | 0.76 | 5 | 1a | .5 |
| 2 | $A_1$ | 1 | — | 35 | — | — |
| 3 | $B_1$ | 1 | — | 8 | — | — |
| 4 | $C_1$ | 1 | — | 45 | 2a | — |
| 5 | $A_1$ | 1 | 0.26 | 60 | 1a | — |
| | $B_1$ | 1 | | | | |
| 6 | $A_1$ | 1 | 0.45 | 65 | 1b | — |
| | $C_1$ | 1 | | | | |
| 7 | $A_1$ | 0.5 | | | | |
| | $B_1$ | 1 | 0.30 | 60 | 1b | 3. |
| | $C_1$ | 1 | | | | |
| 8 | $A_1$ | 1 | | | | |
| | $B_1$ | 0.5 | 0.30 | 85 | 2a | 2. |
| | $C_1$ | 1 | | | | |
| 9 | $A_1$ | 1 | | | | |
| | $B_1$ | 1 | 0.31 | 90, 75 | 2b | 3.2 |
| | $C_1$ | 1 | | | | |
| 10 | $A_1$ | 0.8 | | | | |

TABLE I-continued

| Properties Of EP Agent Blends | | | | | | |
|---|---|---|---|---|---|---|
| | Additive | | 4 Ball | Timken | Copper Corrosion | Oxidation |
| Ex. | Type | Conc. Wt. % | Wear Test 20 Kg, mm | Load, lbs. | ASTM D-130 Rating | Test, Hours |
| | $B_1$ | 1 | 0.28 | 65 | 2b | 3.8 |
| | $C_1$ | 1 | | | | |
| 11 | $A_1$ | 1 | | | | |
| | $B_1$ | 1 | 0.27 | 60 | 1b | 2.2 |
| | $C_1$ | 0.5 | | | | |
| 12 | $A_2$ | 1 | | | | |
| | $B_2$ | 1 | 0.30 | 75 | 4a | 4.5 |
| | $C_1$ | | | | | |
| 13 | $A_2$ | 0.5 | | | | |
| | $B_2$ | 1 | 0.30 | 60 | 1b | 3.1 |
| | $C_1$ | 1 | | | | |
| 14 | $A_1$ | 1 | | | | |
| | $B_2$ | 0.5 | 0.31 | 80 | 2b | 5.4 |
| | $C_1$ | 1 | | | | |
| 15 | $A_3$ | 1 | | | | |
| | $C_1$ | 1 | 0.45 | 75 | 1b | 4.9 |
| 16 | $A_3$ | 0.5 | | | | |
| | $B_1$ | 1 | 0.31 | 70 | 1a | 3.7 |
| | $C_1$ | 1 | | | | |
| 17 | $A_3$ | 1.5 | | | | |
| | $B_1$ | 0.5 | 0.36 | 65 | 1b | 3.8 |
| | $C_1$ | 1.5 | | | | |
| 18 | $A_1$ | 1 | | | | |
| | $B_2$ | 1 | — | 85 | — | — |
| | $C_3$ | 1 | | | | |
| 19 | $A_1$ | 1 | | | | |
| | $B_3$ | 1 | — | 70 | — | — |
| | $C_3$ | 1 | | | | |
| 20 | $A_1$ | 1 | | | | |
| | $B_1$ | 1 | 0.31 | 95 | 1b | 1.0 |
| | $C_3$ | 1 | | | | |
| 21 | $A_1$ | 1 | | | | |
| | $B_4$ | 1 | 0.30 | 80 | 1a | — |
| | $C_3$ | | | | | |
| 22 | $A_4$ | 1 | — | 10 | — | — |
| 23 | $A_4$ | 1 | | | | |
| | $B_1$ | 1 | — | 60 | — | — |
| | $C_1$ | 1 | | | | |
| 24 | $A_5$ | 1 | — | 15 | — | — |
| 25 | $A_5$ | 1 | | | | |
| | $B_1$ | 1 | — | 50 | — | — |
| | $C_1$ | 1 | | | | |
| 26 | $A_6$ | 1 | — | 10 | — | — |
| 27 | $A_6$ | 1 | | | | |
| | $B_1$ | 1 | — | 50 | — | — |
| | $C_1$ | 1 | | | | |
| 28 | $A_1$ | 1 | | | | |
| | $B_2$ | 1 | — | 85 | — | — |
| | $C_8$ | 1 | | | | |
| 29 | $A_7$ | 0.5 | | | | |
| | $B_1$ | 1 | — | 15 | — | — |
| | $C_8$ | 1 | | | | |
| 30 | $A_7$ | 1 | | | | |
| | $B_1$ | 1 | — | 15 | — | — |
| | $C_8$ | 1 | | | | |
| 31 | $A_7$ | 1.5 | | | | |
| | $B_1$ | 1 | — | 20 | — | 1 |
| | $C_8$ | 1 | | | | |
| 33 | $A_1$ | 1 | | | | |
| | $B_1$ | 1 | — | 55 | — | — |
| 34 | $A_1$ | 1 | | | | |
| | $B_1$ | 1 | 0.31 | 95 | 1b | 1.0 |
| | $C_3$ | 1 | | | | |
| 35 | $A_1$ | 1 | | | | |
| | $B_1$ | 1 | 0.30 | 100 | 1b–2a | 2.2 |
| | $C_3$ | 2.0 | | | | |
| 36 | $A_1$ | 1 | | | | |
| | $B_1$ | 1 | 0.27 | 70 | 4c | 2.5 |
| | $C_6$ | 1 | | | | |
| 37 | $A_1$ | 1 | | | | |
| | $B_1$ | 1 | 0.30 | 80 | 4c | 4.2 |
| | $C_7$ | 2.0 | | | | |

These data show, in particular, the superior EP properties contributed by the additives of this invention as well as the excellent antiwear and noncorrosive and stability properties of the compositions.

The examples illustrate a wide variety of each of the classes of additives. Note Examples 22–27 show the ineffectiveness of the partial esters of lower-molecular-weight additives as EP additives. Note also that Examples 29–31 show the adverse effect on EP exhibited by the prior art amine salt of the partial ester. In addition, the three component system was tested in the FZG Gear Test. This test measures the antiscuffing properties of oil for reduction gears, hypoid gears, automatic transmission gears and the like. A description of the test and the meaning of the results can be found in the article "Scuffing Tests on Gear Oils in the FZG Apparatus" by G. Niemann, H. Rettig and G. Lechner in ASLE Transactions, 4 71–86(1961).

The present FZG Test was run at "double speed", e.g. 3600 rpm at 90° C starting temperature. The composition comprised 1% by weight each of $A_1$, $B_1$, and $C_1$ in a 90-grade gear oil. The base oil alone fails the test at 4–5 stages. The compounded oil passed 12 stages.

Table II illustrates the effect by varying the degree of esterification of the acid. Timken tests were performed on using base oil containing 1% each of the poly(isobutene dithioether) ($C_1$) and tricresyl phosphates. The third component was dimer acid, nonesterified, half esterified and full esterified with isopropanol.

TABLE II

Effect Of Degree Of Esterification On EP Properties

| Example | % Esterified | Timken Load, lbs. |
|---|---|---|
| 38 | 0 | 55 |
| 39 | 50 | 95, 90, 85 |
| 40 | 80 | 50 |

These data indicate that neither the free acid nor the completely esterified ester has significant activity as an EP agent, as $B_1$ and $C_1$ at 1% concentration each alone gave a Timken EP value of 45 lbs.

All specific embodiments of the invention have been described in detail, and it should be understood that the invention is not limited thereto as many variations will be readily apparent to those skilled in the art. Thus, the invention is to be given the broadest possible interpretation within the terms of the following claims.

What is claimed is:

1. A lubricating composition comprising a major portion of lubricating oil or grease, and a minor portion, from about 0.2% to about 10% by weight of an extreme pressure additive, said additive comprising one part of (A) a partial $C_1$–$C_{10}$ alcohol ester of a di- or tricarboxylic acid of from 18 to 80 carbon atoms, from 0.5 to 2 parts of (B) a thioether having a molecular weight in the range of 100 to 10,000 and a minimum sulfur content of 5% by weight, and from 0.5 to 2 parts of (C) a hydrocarbyl phosphate having a molecular weight in the range of 100 to 10,000.

2. The composition of claim 1 wherein (A) is an ester of a dimer of linoleic acid.

3. The composition of claim 2 in which (A) is the isopropyl ester.

4. The composition of claim 1 wherein the acid portion of (A) is from about 20% to 80% esterified.

5. The composition of claim 4 in which the acid is from about 30% to 70% esterified.

6. The composition of claim 1 in which (B) is a sulfidized cracked wax olefin.

7. The composition of claim 6 in which the olefin contains from about 10 to 20 carbon atoms.

8. The composition of claim 1 in which (C) is a triaryl phosphate.

9. The composition of claim 8 in which the phosphate is tricresyl phosphate.

* * * * *